US006021588A

United States Patent [19]

Alviso

[11] Patent Number: 6,021,588

[45] Date of Patent: Feb. 8, 2000

[54] SHOE ASSEMBLY

[76] Inventor: Todd Alexander Alviso, 255 N. El Cielo Rd. Suite #617, Palm Springs, Calif. 92262

[21] Appl. No.: 09/152,753

[22] Filed: Sep. 14, 1998

[51] Int. Cl.[7] ..... A43B 1/10; A43B 13/04; A43B 13/12

[52] U.S. Cl. ..... 36/102; 36/114; 36/32 R; 36/30 R; 36/11.5

[58] Field of Search ..... 36/102, 103, 59 C, 36/30 R, 59 R, 114, 11.5, 32 R

[56] References Cited

U.S. PATENT DOCUMENTS 4,372,059 2/1983 Ambrose .
4,546,556 10/1985 Stubblefield .
5,384,973 1/1995 Lyden .
5,651,195 7/1997 Clancy .
5,784,808 7/1998 Hockerson .
5,806,209 9/1998 Crowley et al. .
5,862,614 1/1999 Koh .

FOREIGN PATENT DOCUMENTS 9111124 8/1991 WIPO .

*Primary Examiner*—Ted Kavanaugh

[57] ABSTRACT

A shoe assembly is described which is designed and constructed to permit and enhance the normal action of a human foot received in the shoe assembly during a stride and while standing. Among other things, the assembly includes a heel shaped to approximate the lower and rear shape of the calcaneum bone of the human foot, and separate relative moveable pads underlying the lateral arch and various contact points in the forefoot area of the human foot. Also, the thickness of the heel area is substantially the same as the thickness of the toe area, thereby to maintain the skeletal and muscular structure of the body above the foot in its natural position.

17 Claims, 13 Drawing Sheets

SHOE ASSEMBLY

BACKGROUND

The construction and action of the human foot has evolved over many millennia. During most of this evolution, typically people walked barefoot on dirt, sod, or similar surfaces that tended to yield or give as pressure was applied by the foot.

In recent centuries it has become increasingly customary to encase the foot in a shoe construction typically characterized by certain features, including a raised heel and last or envelope molded to closely fit the foot. Both of these features distort the action of the human foot, and the human body, while walking or standing. The raised heel tends to pitch the body forward requiring its musculature to counteract the tilt. This also tends to restrict or limit the action of various muscles, such as the calf muscles, while walking to in turn reduce the pumping action they exert on the blood and lymphatic flow through them. The molded last portion of the shoe tends to impede, prevent, or exaggerate the pronation or splaying action of the foot as weight transfers from the heel across the arches to the forefoot structure during the contact portion of a typical stride. But most people have become accustomed to such a shoe construction and do not now associate these features with any resulting musculature or skeletal problems they may experience, even though these features can contribute significantly to such problems.

The principal objective of the present invention is to provide a shoe construction or assembly designed to at least permit, and in a preferred embodiment to enhance, the normal action of the human foot both while standing and while striding. Another objective is to provide a balanced shoe construction or assembly that includes features and materials selected and interrelated to enhance the flow of energy through the components of the shoe assembly during the contact portion of the stride. A further objective of the present invention is to provide a shoe construction that is adaptable to various types of footwear such as sneakers, sandals, brown shoes, casual/dress shoes, and boots, thereby to extend the advantages of the invention to substantially all of the activities typically requiring shoes.

These and other objectives of the invention will be apparent to those skilled in this field from the following description of preferred embodiments of the invention.

BRIEF SUMMARY OF THE INVENTION

The shoe assembly of the present invention provides an upper portion connected to a sole portion of the shoe thereby to form a shoe for the human foot. The sole portion preferably consists of interconnected portions, including at least a midsole portion and an outsole, or outer sole portion, the bottom of which defines a base surface. The outer sole portion consists of a series of pads movable relative to one another including at least a heel pad and a sequence of forefoot pads at least some of which underlie and support the pressure points exerted by the forefoot skeletal structures through the fat pads of the human foot received in the shoe while standing and during a stride. The sole portion has a heel area and a toe area, the heel area being approximately as thick as the toe area, thereby to avoid tipping skeletal elements above the foot forward or rearward relative to the base surface of the shoe.

Preferably the outer surface of the heel pad is shaped to approximately the lower or plantar shape of the calcaneum bone as exerted through the underlying fat pad, thereby to enhance the normal motion of the human foot during the contact portion of a stride.

Preferably the sole portion includes a midfoot area to underlie the arch of a human foot received in the shoe, the medial midfoot area being raised relative to the heel pad and forefoot pads, the materials of the sole portion being selected and interrelated to support, respond to and enhance the normal pronation and supination action of the foot, and particularly of the lateral and the medial arch from heel strike to push-off.

BRIEF DESCRIPTION OF THE DRAWINGS

The invention will be further described in connection with the accompanying drawings in which.

DETAILED DESCRIPTION

Figure 1:
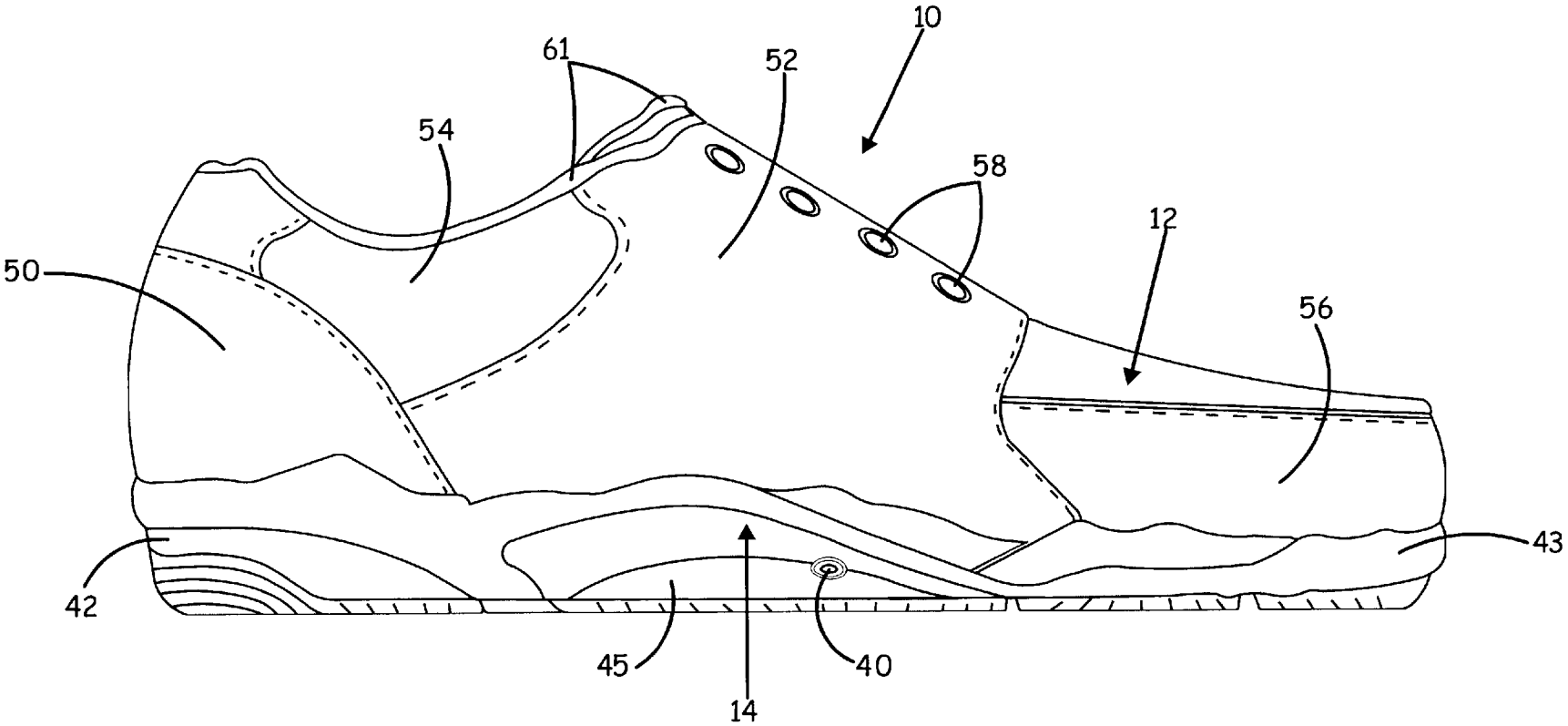
FIG. 1 is a medial elevation view of a sneaker style of the shoe assembly.

To fully understand and appreciate the various components of the preferred shoe assembly and how these components interrelate it is first necessary to understand the natural action of the human foot.

There are many reference texts which describe and illustrate the construction and action of the human foot. For that reason, these topics will only be briefly addressed here.

In general the human foot consists of three bone groups, the two large tarsal bones beneath the ankle, the five small tarsal bones in front of the large bones, and the long bones of the anterior half of the foot. These long bones include a set of five metatarsal bones, each extending to a set of phalange bones, namely a proximal, then middle, then distal phalange. The construction of these bones telegraphs the action of the human foot while walking. The larger of the tarsal bones, namely the calcaneum or heel bone, includes a lower or rearward surface shaped to contact the ground while the foot is turned outward from 12 to 18 degrees, then to accept and transfer the weight of the human body forward from heel strike primarily to the lateral side of the foot during roll-forward, then to the medial arch during midstance, then to the forefoot, terminating as the big toe pushes off and the foot swings forward during the non-contact portion of the stride to receive and transfer the weight of the body in this same manner during the contact portion of the next stride.

The human foot, and the skeletal and musculature structure above it, is designed to achieve and maintain a fluidity of movement, the force being applied to the foot structure and through its fat pads to the ground, as weight is transferred to the foot naturally rolling forward on the foot, then pronating or relative flattening of the arches of the foot, particularly the lateral arch, medial arch, and metatarsal arch, the forefoot splaying as weight transfers along the forefoot to push-off.

The skeleton of the human foot displays clear and natural contact points with the ground, these regions being generally identified by the subcutaneous fatty tissues or fat pad, of the foot's sole. In addition to the surfaces of the calcaneum just mentioned, the contact points or regions include that adjacent to the tuberosity at the distal base of the shaft of the fifth metatarsal, that adjacent the sesamoids underlying the heads of the metatarsals, and in general the region adjacent the knotty ends of the forefoot bones particularly including the middle and distal phalanges.

This skeletal structure is interconnected by various ligaments and driven by the tendons and various muscles which, among other things, are designed to maintain the shape of the foot and to absorb and transfer the forces applied to the foot while standing and walking. The major arches which absorb and transfer these forces are the lateral arch, the medial arch, and the metatarsal arch. As the forces transfer, the arches alternate between pronation then supination, these actions causing the contacting portions of the foot to move or adjust on the supporting surface.

Most shoe constructions largely prevent, restrain, or exaggerate these natural actions of the human foot during walking or standing. They often provide a raised heel, which not only tends to tilt the skeleton but also to throw off the direction of the forces applied by the foot to its supporting surface during the contact phase of a stride. Further, they tend to constrain the foot, and prevent the natural action of its arches and its natural pronation or splaying during the stride.

The preferred construction of the present shoe assembly seeks to enhance the natural action and movement of the human foot while standing, walking or running (generally referred to as a stride or gait). This shoe assembly or construction can be applied to any of various types of footwear. Three general types are illustrated here: A sneaker or oxford type, a sandal, and a mid-top shoe or boot such as typically worn while playing basketball or hiking.

All of the shoe constructions shown in the various figures, and discussed in the application, are for a shoe intended to be worn by a human male on the left foot. Of course, a shoe construction for the right foot would be the mirror image of that for the left foot, and preferably would be made to incorporate all of the features herein described for the left foot construction determined. A shoe construction for the human female would be somewhat different, to receive a foot with a narrower heel and a relatively wider forefoot, and of a lighter person.

FIGS. 1 through 9 illustrate a sneaker or oxford-type shoe assembly such as taught by the present invention. In a general way it is constructed in a manner similar to the way many sneakers are made today, but with certain very distinctive differences. Basically the shoe or sneaker 10 consists of an upper assembly 12 and a sole assembly 14. As probably best shown in FIG. 3, a vertical cross-section through the longitudinal center of the medial arch of the shoe, the sole assembly 14 preferably consists of an insole portion 20, a midsole portion 22, and an outsole or outer sole portion 24. The insole portion may provide two layers, a thin inner sponge like layer 26 such as Sorbathane, and a stiffening layer 28.

The relationship of these layers to one another and to the human foot received in the shoe are important. The outsole portion 24 preferably consists of a sequence of pads 29 movable relative to one another, the pads being formed of a durable material. In general, I prefer all components of the shoe to be made of natural, non artificial, organic materials. However, today shoes often have soles made of manufactured substances such as polyurethane. The midsole portion 22 is formed of a resilient material such as a natural rubber or an ethyl vinyl acetate polymer. The midsole and outsole portions of the shoe advantageously may be formed or cast together such as by first forming the pads 29 of the outsole portion connected to one another by thin weblike strands, which loosely hold the pads together and facilitate the outsole portion being placed in a mold that then receives the material which forms the midsole portion. The specific nature and relationship of the midsole and outsole portions will be discussed shortly.

Figure 4:
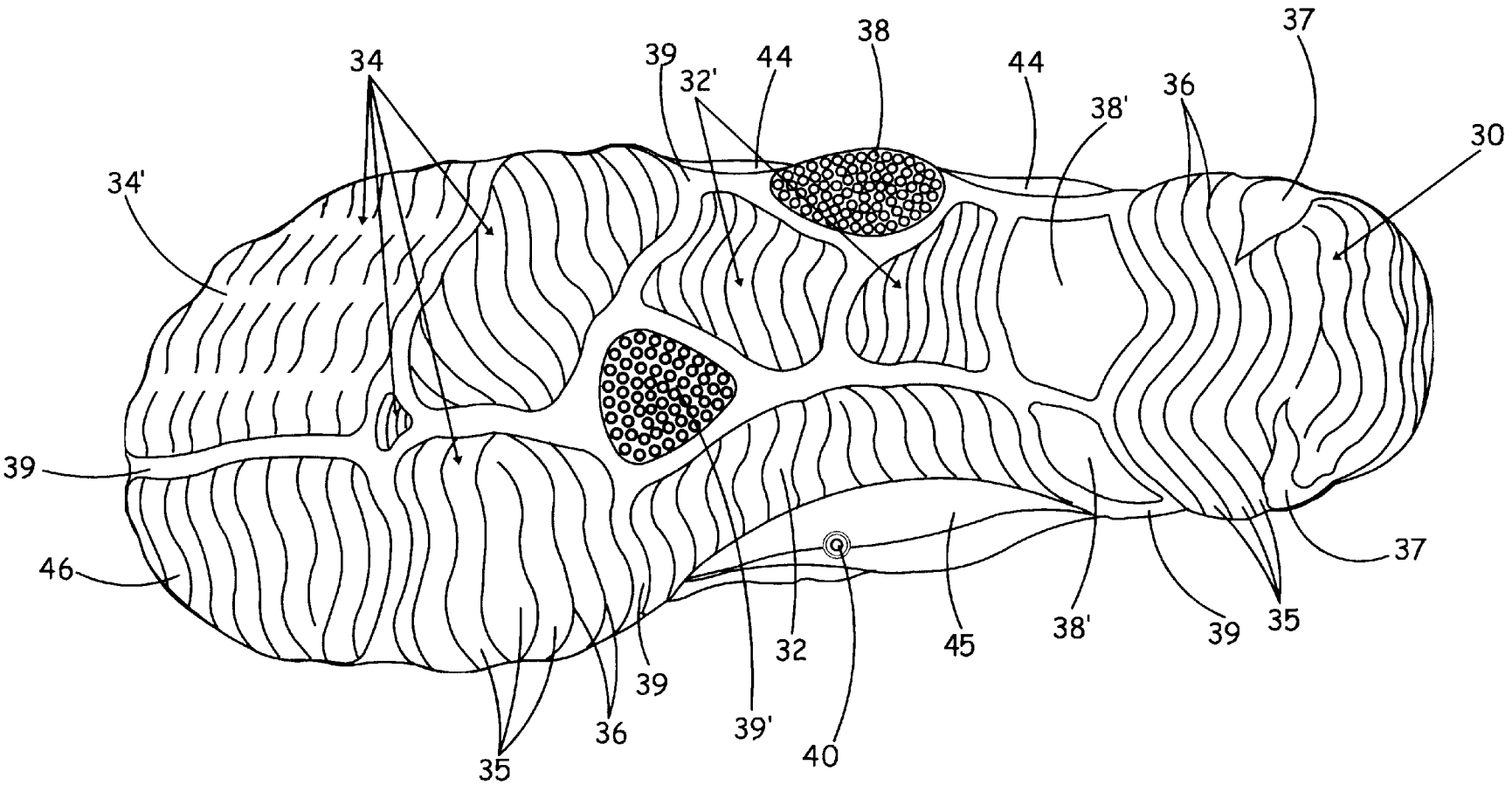
FIG. 4 is a bottom view of the sneaker.

A preferred shape or design of the outsole pads is shown in FIG. 4, a bottom view of the preferred shoe. In general, outsole pads include a heel pad 30, medial arch and lateral arch pads 32, and a series of forefoot pads 34 and 46. While specific shapes and locations for these pads are shown in FIG. 4, in general the pads are shaped and located to underlie the main pressure points applied by the foot's skeletal structures through the fat pads of the sole to the ground or other surface during the contact portion of a stride. Each outsole pad preferably consists of wavy ridges 35 separated by grooves or indentations 36, the pads being formed of a material sufficiently durable to resist wear and provide a shoe of reasonable longevity.

Figure 5:
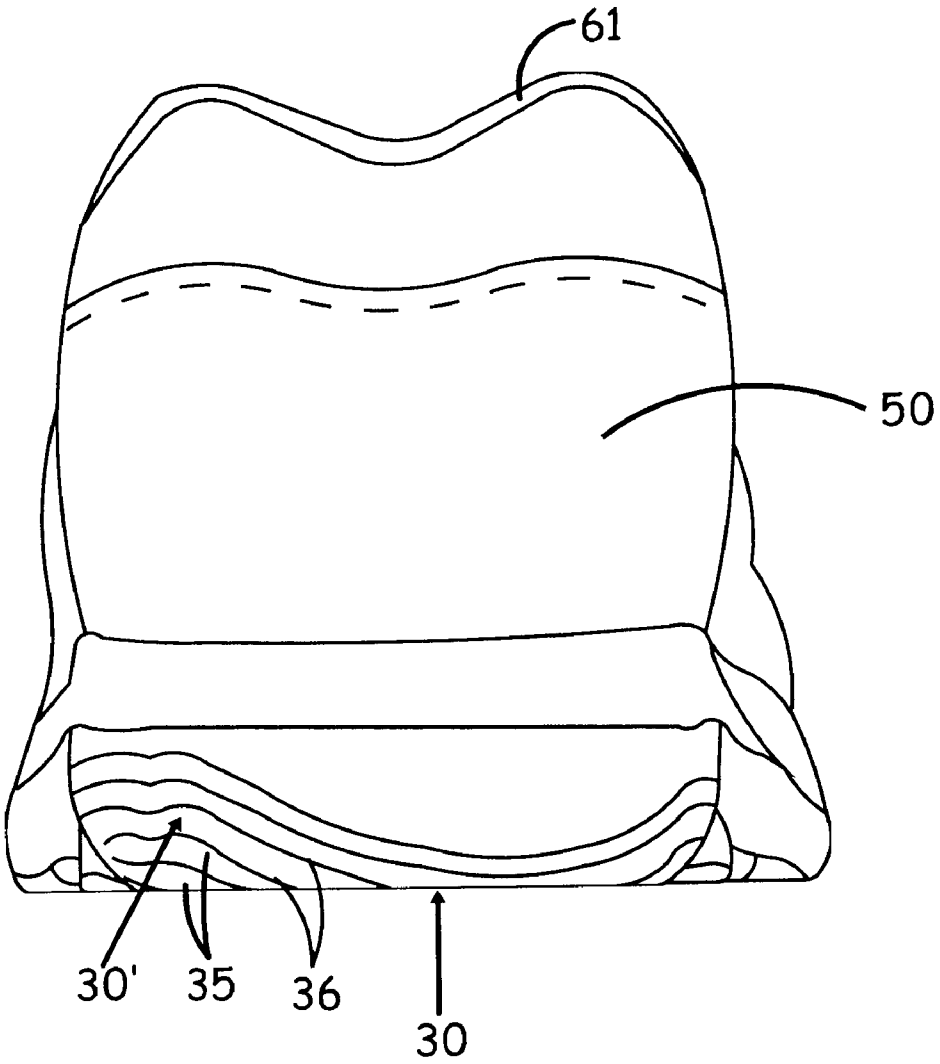
FIG. 5 is a rear view of the sneaker.

Heel pad 30 includes recessed zones 37 of a particular shape. Also, the rear portion 30' of heel pad 30 extends part way up the back side of the heel portion of the shoe, as shown in FIG. 5, and provides surfaces which generally mimic the rear and bottom surfaces of the calcaneum or heel bone of the human foot.

The rear portion 30' of heel pad 30 extending up the back of the shoe and provides a surface angled to engage the ground during initial contact of the foot with the ground while the foot is turned outward and angle of approximately 15 degrees. This orientation approximates the orientation determined by the surface of the calcaneum. As the foot engages the ground at an weight is applied to the heel, the heel and shoe rock forward on the flat bottom surface of the shoe's heel, which is the action natural to the human foot. At the next moment during a typical stride weight is applied primarily along the lateral arch of the foot causing lateral arch supports 44, to collapse or move downwardly as the lateral arch of the foot pronates. The resiliency of the sole portion of the shoe is such that this pronation occurs.

At the next moment during the stride, the application of weight to the foot moves forward to the forefoot area, causing the lower protuberances of the phalange and the adjacent heads of the metatarsals to come to bear through their fat pads, applying force through the various forefoot pads 34 to the ground. As this occurs, the medial arch and arch support 45 also pronates, and the forefoot splays outward. Again, the resiliency of the shoe's elements allows this to occur without significant constraint. Further forward motion of the foot during the stride transfers the weight from the forefoot to the big toe area 46 during push-off. Then the foot and shoe lilt from the ground and are swung forward for the next contact or step.

Throughout the time the sole of the foot is in contact with the ground through the shoe's sole during a stride, energy is being transferred first to the heel and then from the heel primarily through the lateral arch to the forefoot area and the medial arch, then in a smooth motion to release from the ground, after the big toe has pushed off. The energy applied to the heel and then transferred through the lateral arch to the forefoot and medial arch must be transferred in some fashion.

The preferred construction of the shoe assembly is designed with this in mind. Among other things, the shapes and densities of the various regions of the sole assembly are chosen and interrelated to enhance this transfer of energy during a stride. The outsole pads are the hardest, while the midsole portions between the outsole pads are softer.

Preferably, lateral arch pad 38 is slightly softer than the outsole pads, and is located, shaped and provided with a series of cylindrical holes to direct force to the middle of the sole while allowing the metatarsal arch to pronate. The regions 38' of the sole assembly are of a density similar to pad 38, while channels 39 are of a softer material to permit outsole pads 29 to moverelative to one another as previously stated. The central, generally triangular pad 39' pointed toward the heel underlies the metatarsal arch, is of a density similar to pad 38, and has a series of projecting cylindrical pins.

The wavy ridges in the outsole pad 34' underlying the smaller distal phalanges, or toes, are interrupted generally in the regions between the phalanges. This is a preferred, but not essential, configuration.

In one construction of the preferred shoe, it is desired that some energy-absorbing element be located at the medial arch approximately underlying the first cuneiform, such as element 40 shown in FIG. 4. This element may simply be an opening through all or part of the sole, or a cylindrical member or disc of a density appropriate to the size of the shoe and the material used, or it could be simply one or more grooves in the midsole. Here it is shown as a cylindrical element with an outer band or ring that is even softer than the cylinder.

The sides or outer edges of the various outsole pads 29 are preferably somewhat wavy, as shown, in part to help anchor the shoe to the ground during push-off. Also the upper margins 41 of the outsole pads, and of the midsole, along the sides of the shoe are somewhat wavy. This wavy configuration enhances the movement of the pads relative to one another and allows the side portions of the shoe to fold or crease as necessary to enable the previously stated pad motions to occur. While the density of the foot pads 30, 32, and 34 provides a shoe of normal wear characteristics, the density and nature of the midsole material should be selected to enhance the transfer of energy just described and to permit the splaying action normal to the foot during the contact portion of the stride. Also, preferably the outer surface of the midsole is of increased density as shown and extends up the sides of the sole, as shown for example in FIGS. 1 and 2.

Figure 2:
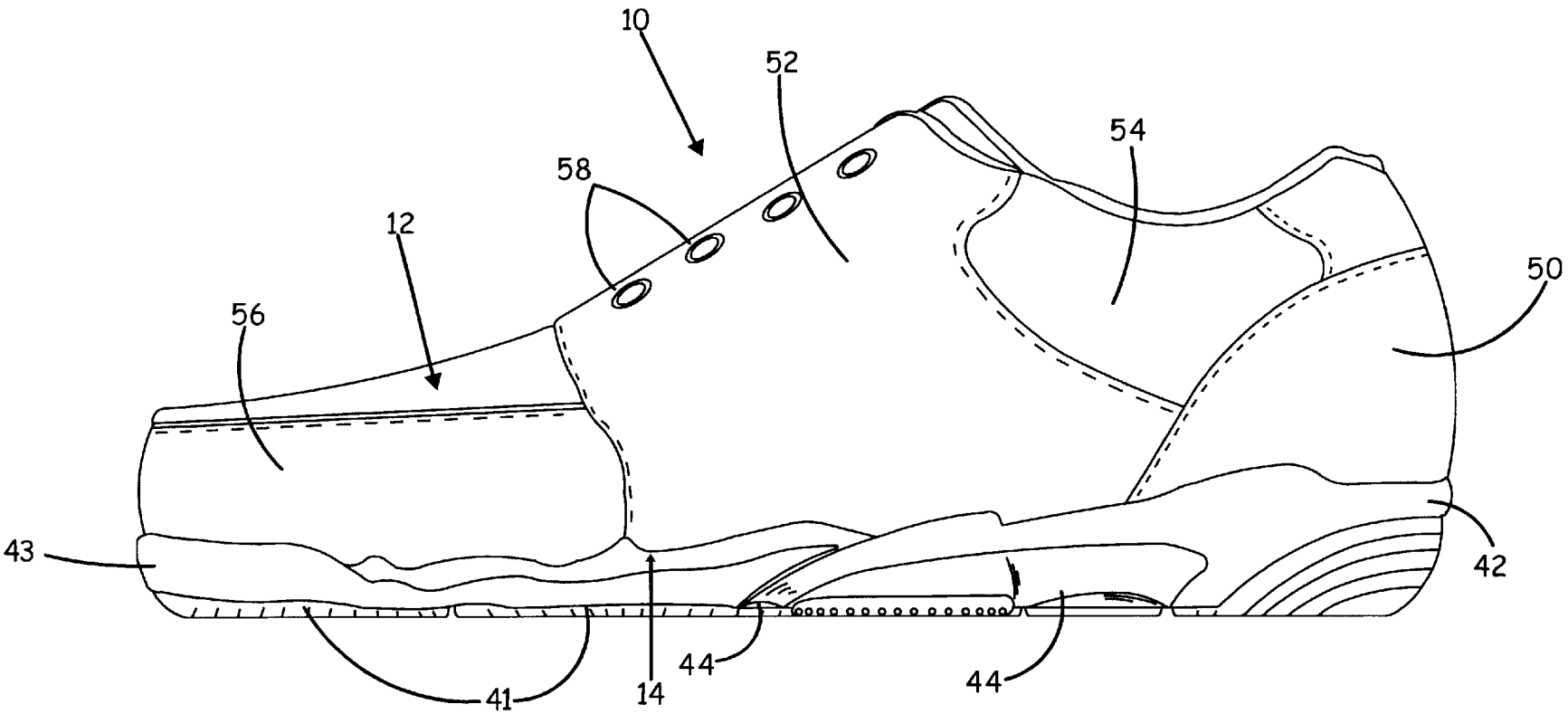
FIG. 2 is a lateral elevational view of the sneaker.

The sole terminates in a heel cup 42 and in a forefoot wall 43. Wall 43 preferably extends not only around the forefoot area but also at least partially back along the lateral arch of the foot as shown in FIG. 2. The upper margins of both heel cup 42 and forefoot wall 43 should be of a wavy shape generally as shown thereby to permit the upper portion 12 of the shoe to give or ripple as forces are applied by the foot to the shoe assembly during normal contact portion of each stride.

In general, the upper assembly 12 may consist of a heel panel 50 and a medial arch panel 52 connected to one another by a side panels 54. The forefoot panels 56 of the upper may be constructed to simulate a typical moccasin, as shown in FIGS. 1 and 2, or to present any other desired appearance. The medial arch panels 52 have at their upper margins a series of eyelets 58 that receive typical lacing used to draw the medial arch portions together to provide a comfortable fit of the shoe about the foot.

Preferably the various margins of the various components, such as the top of tongue 60 and upper edge of heel panel 50 and side panels 54, terminate in the rolled edge 61 of soft material the also extends within the shoe in a conventional fashion.

As previously stated, the normal action of the human foot while walking includes a splaying or pronation of various arches, such as the lateral arch and the medial arch. To help adapt the shoe to this action without significant restriction, the lateral margins compress and extend to provide support while standing and motion while ambulating.

Figure 6:
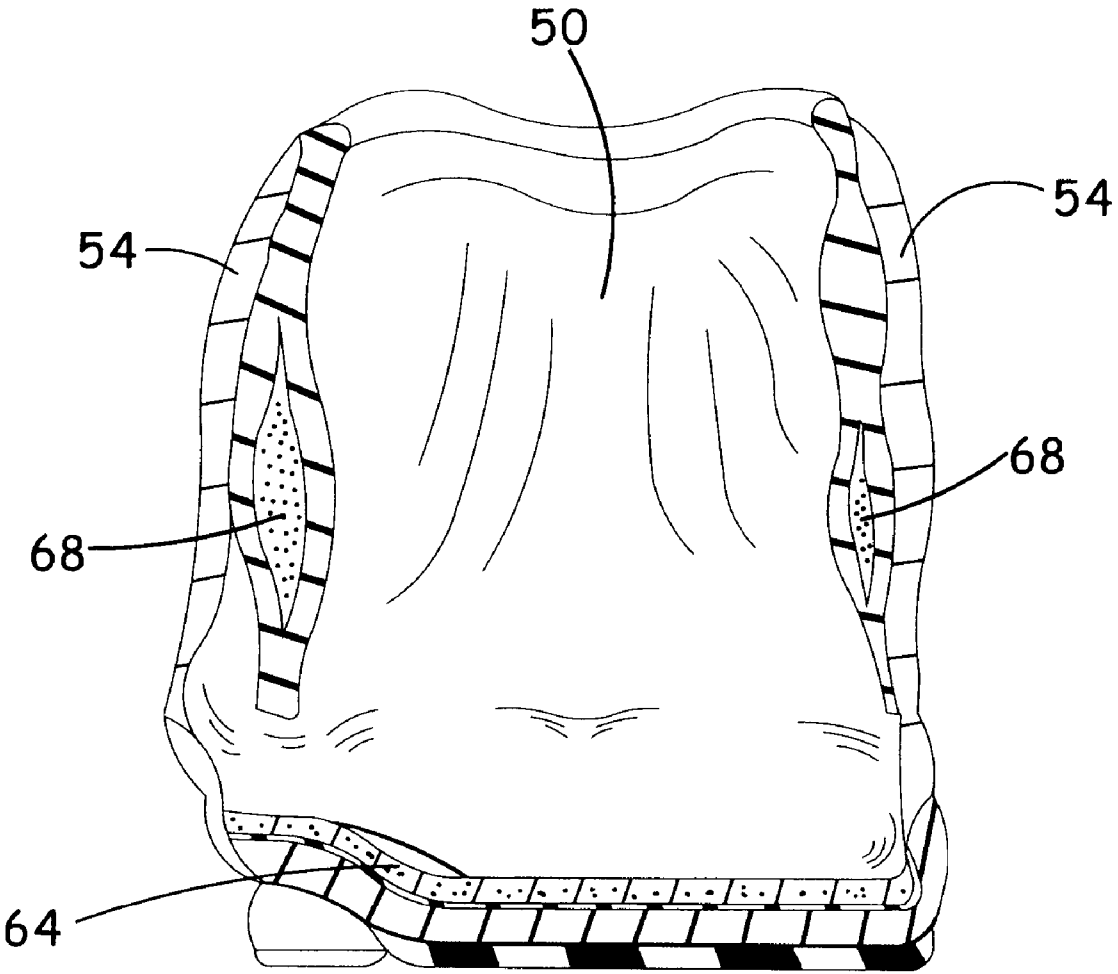
FIG. 6 is a vertical lateral cross sectional view of the sneaker.

As shown in FIG. 6, a vertical section through the arch of the shoe taken in a direction looking towards the heel cup, the surface of the midportion of the shoe is raised on the medial arch surface 64 and lateral arch portions where the arches are present. Also, various panels of the shoe may include padding of desired, such as padding 68 in side panels 54.

Figure 7:
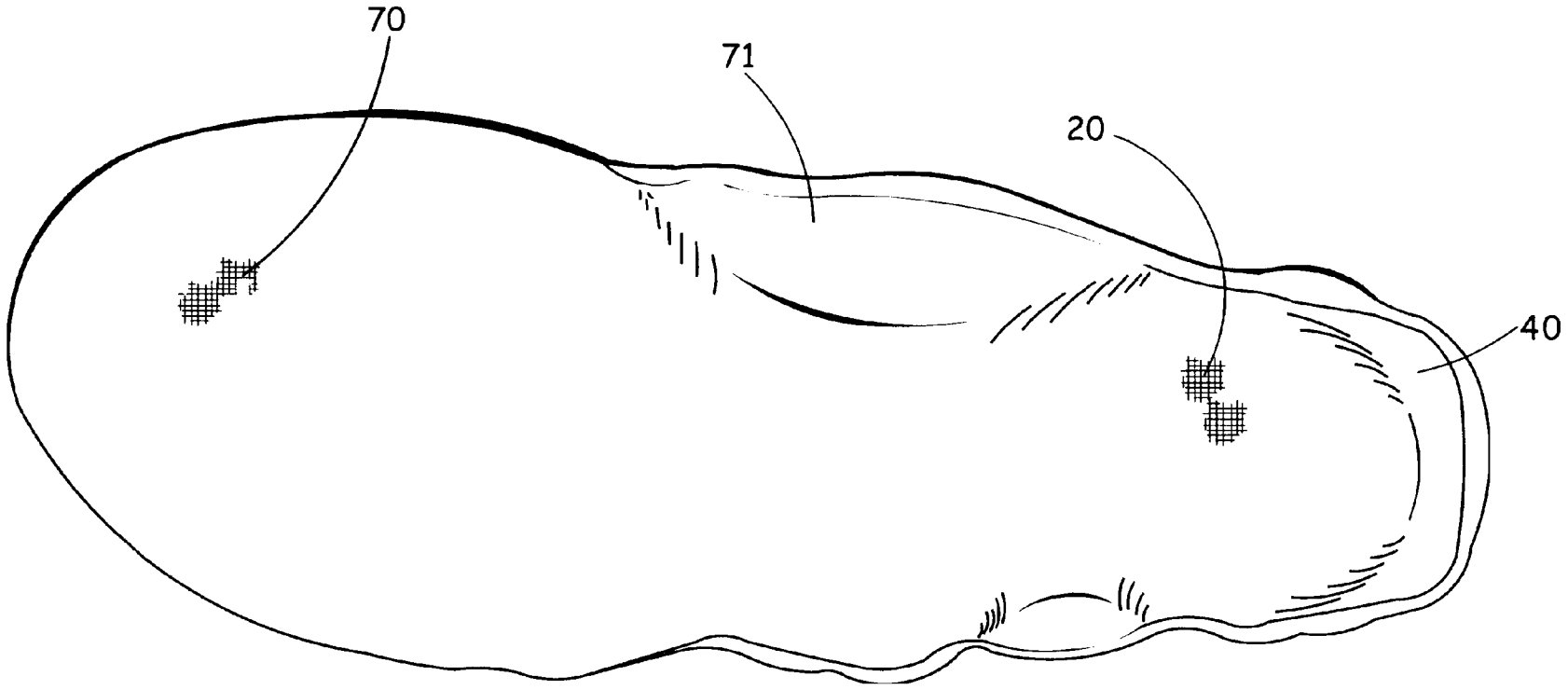
FIG. 7 is a horizontal cross-sectional view of the sneaker.

FIG. 7 presents a horizontal section taken through the upper portion of the shoe above the insole. It shows the upper surface 70 of the insole 20, which surface generally may be of a woven or crosshatched pattern. The medial arch portion 71 of the insole may be raised to follow the natural form of the foot, and has indentations to enhance the tendency of the insole in this area to flex or relax and allow the natural pronation motion of the foot during a stride while providing some arch support. Preferably the heel cup region 40 closely circumscribes the heel of a foot received in the shoe assembly to provide good heel support and stability especially during the heel strike phase of a stride.

Figure 8:
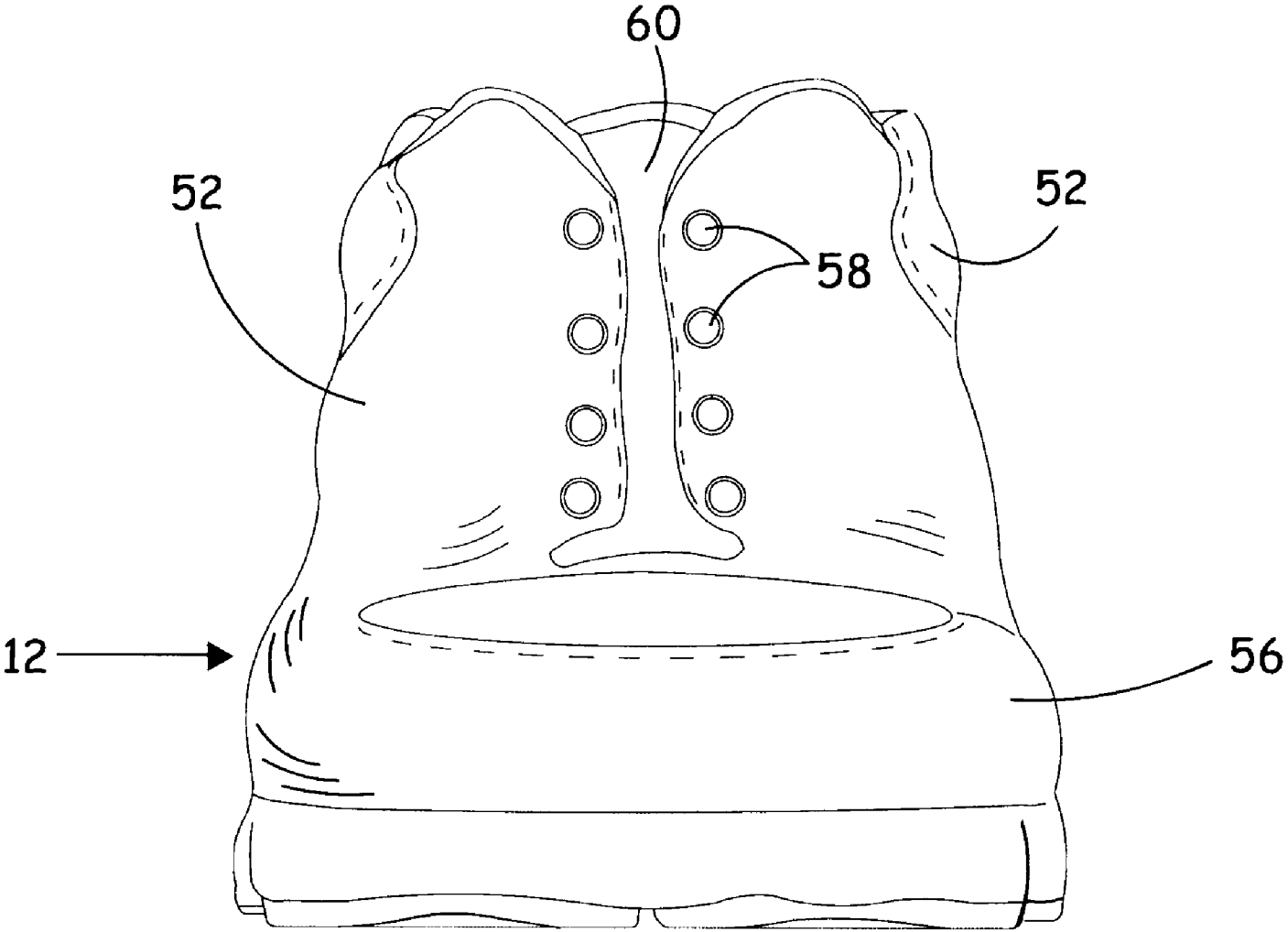
FIG. 8 is a front view of the sneaker.
Figure 9:
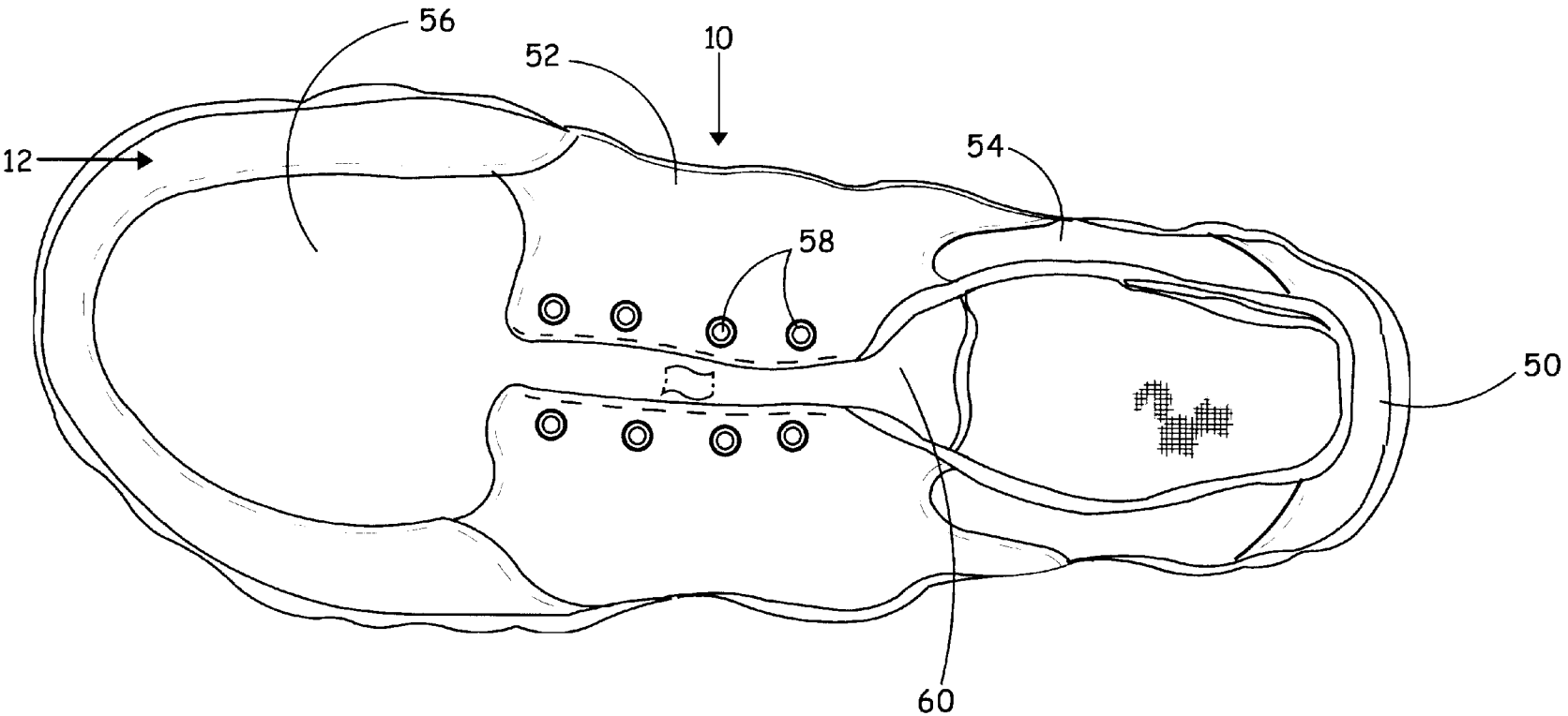
FIG. 9 is a top view of the sneaker.

FIG. 8 is a front view, and FIG. 9 is a top view, of the previously described shoe assembly.

Figure 10:
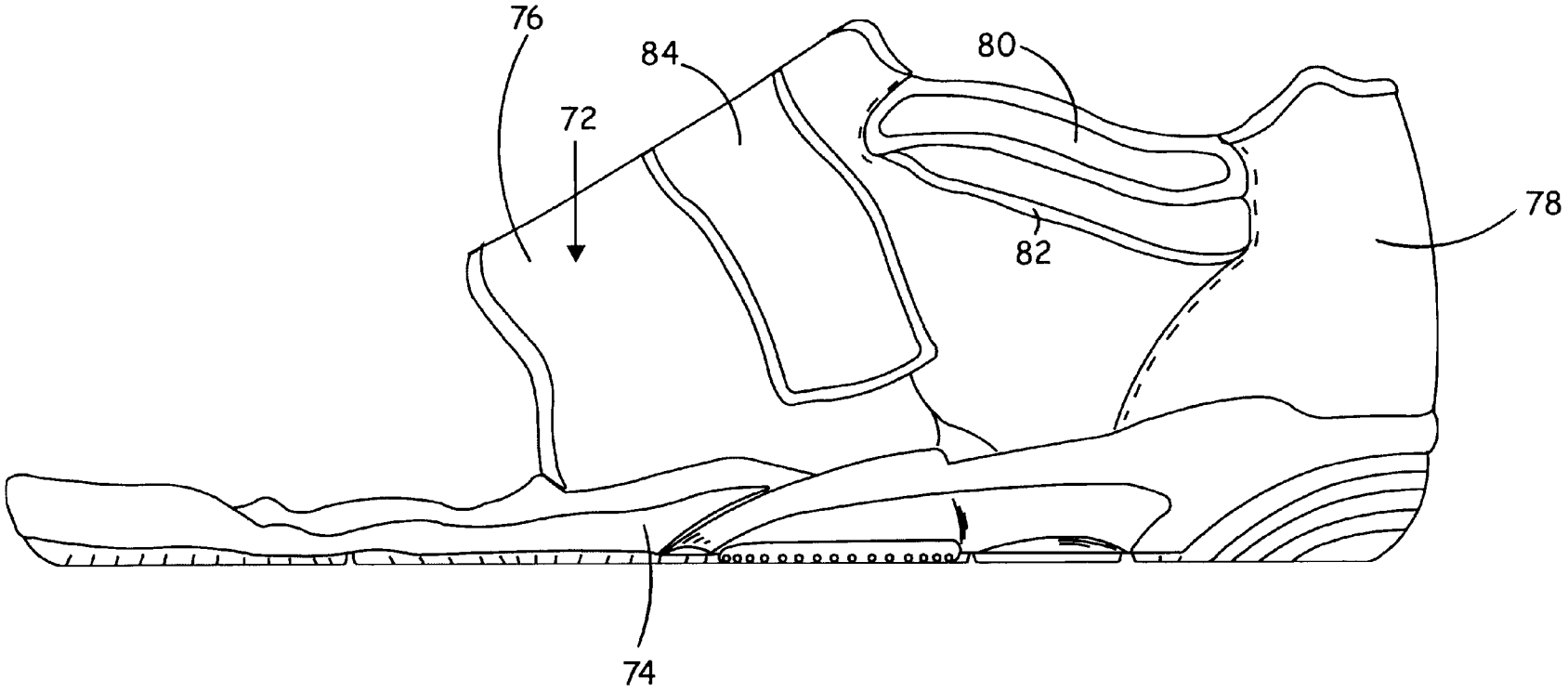
FIG. 10 is a medial elevational view of the sandal style of the shoe assembly.
Figure 11:
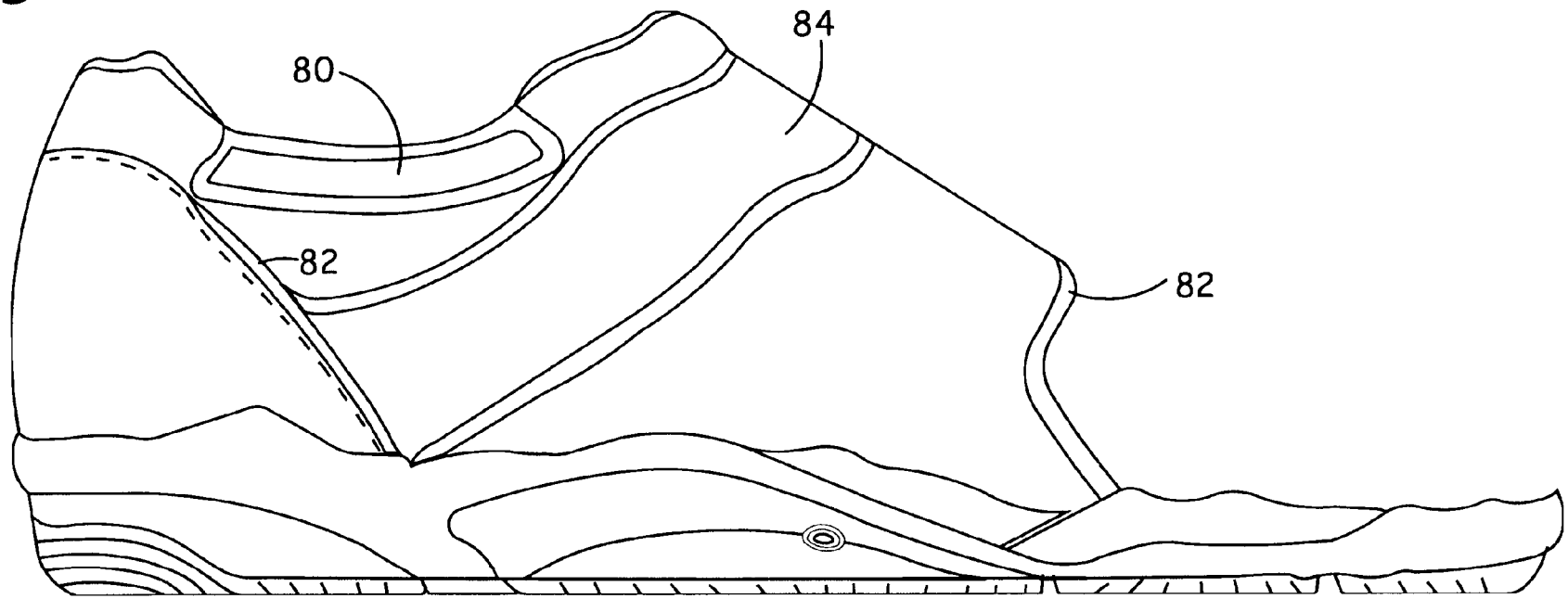
FIG. 11 is a lateral elevational view of the sandal style of the shoe assembly.

As previously indicated, the preferred construction of the shoe may be adapted or applied to footwear of various types. For example as show in FIGS. 10 and 11, the preferred shoe construction may be provided in a sandal having an upper portion 72 and a sole portion 74. In virtually all respects the sole portion 74 is identical to the sole portion 14. Upper portion 72 includes an elastic medial arch panel 76 and a heel cup panel 78, elastic band 80 connect the upper edge portions of the heel cup panel to the medial arch panels generally as shown. The forefoot or toe panel of the sandal is open. Preferably the exposed edges of the panel are covered with a soft piping 82 for comfort. A resilient or elastic strap 84 is attached at one end to the medial side of the heel cup panel 78, and may be drawn by the wearer across the arch as shown to be secured, as by cooperating Velcro panels, to the lateral side of medial arch panel 76. The medial arch panel preferably is formed of a rubberized Neoprene water resistant material.

Finally in this embodiment of the invention, the medial arch panel and the cup cooperates with the cup panel and elastic bands 80 and straps 84 to hold the sole portion 74 against the sole of a foot received in the sandal, while allowing the natural pronation of the foot's various arches, the foot encountering the ground during a stride much as previously described with respect to the sneaker or dress shoe construction assembly.

Figure 12:
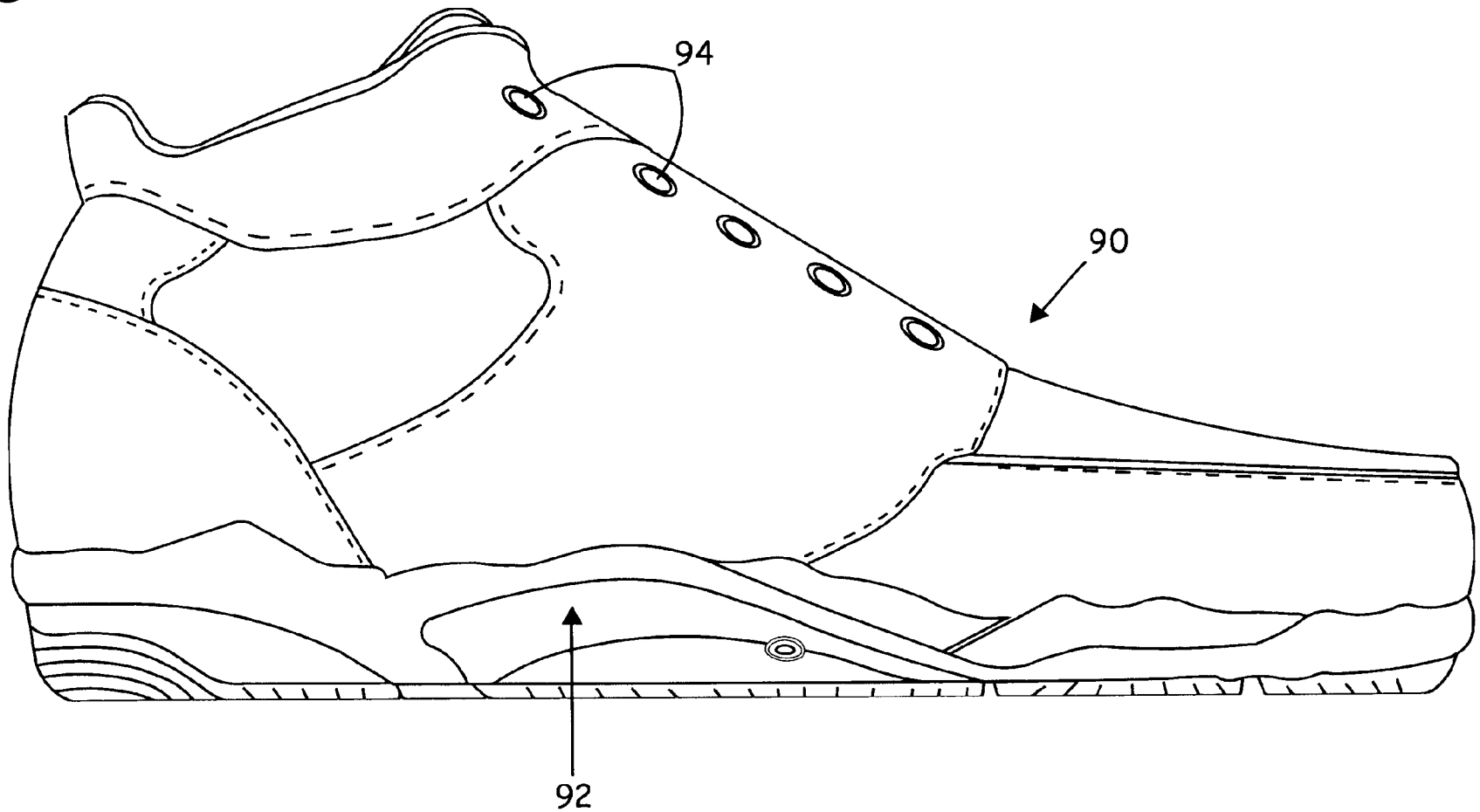
FIG. 12 is a medial elevational view of a mid-top style of the shoe assembly.
Figure 13:
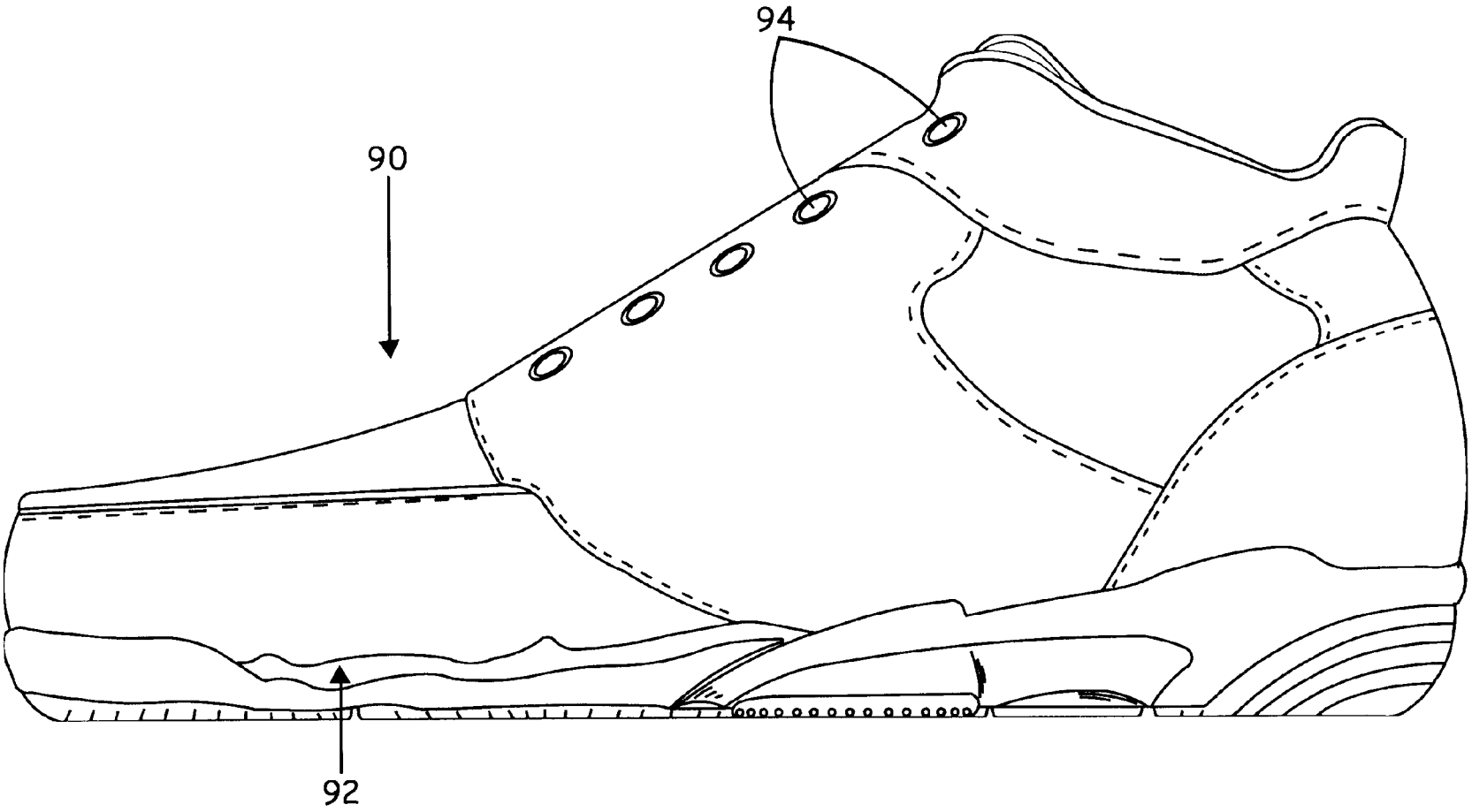
FIG. 13 is a lateral elevational view of a mid-top style of the shoe assembly.

FIGS. 12 and 13 illustrate generally the construction of a mid-top shoe or basketball shoe incorporating the features of the present invention. In general it consists of an upper portion 90 and a sole portion 92, the sole portion 92 being essentially identical to sole portion 14. The only significant difference between upper portion 90 and upper portion 12 is that the upper margins of the various side and rear panels of the mid-top shoe extend upward beyond the ankle of the foot received in the shoe and are provided with a series of eyelets 94 to permit these panels to be tightened around the ankle thereby to provide significant support to the ankle.

There are various features of the present shoe assembly which are believed to be highly important. These features include the fact the heel area is not provided with a wedge or is not substantially thicker than the midfoot portion or the forefoot portion. Thus, one wearing these shoes when standing will experience the contact of the foot with the ground that gave rise to the particular skeletal and muscular construction of the human foot many millennia ago. This in turn will orient the skeletal and muscular structures above the foot as they were intended or designed or as through usage came to be the natural orientation. No forward or backward tilt will be imparted to these structures. Similarly, while walking and wearing one of the present shoe assemblies, the wearer will experience a foot motion in harmony with the skeletal and muscular construction of the foot. Thus, the present shoe assembly will enhance the normal foot action experienced while walking from heel strike through roll-forward to pronation and push-off. A natural and smooth action will be experienced. There will be no unnatural jarring or twisting of the foot. The natural contact points of the foot will engage the underlying surface, as will the normal splaying action of the foot during roll-forward on to the forefoot. Energy will be transmitted in a natural way from the heel through the lateral arch to the forefoot and then returned to the medial arch. In these and other ways the present shoe assembly is believed to significantly contribute to an enhanced stance ease of the human body on its feet, and to an enhanced ease of action during a stride, whether walking or running.

While preferred embodiments of the invention have been described and specific features of the invention have been discussed, the invention is not limited to nor defined by these specific elaborations. Instead, it is as set forth in the following claims.

I claim:

1. A shoe assembly for containing and supporting the foot of a human and for use while standing and striding, the shoe assembly having an upper portion connected to a sole portion, the sole portion comprising interconnected portions including at least a midsole portion and an outer sole portion the midsole portion being of a resilient material;

the outer sole portion being of a durable material and comprising a sequence of pads bonded to the midsole portion, the resiliency of the midsole portion being such that the pads are movable relative to one another, the pads including at least a heel pad located to underlie the heel of a foot received in the shoe, a lateral arch pad located to underlie the lateral arch of a foot received in the shoe, a medial arch pad located to underlie the medial arch of a foot received in the shoe, and a pattern of forefoot pads located to underlie the forefoot of a foot received in the shoe, the forefoot pads including at least some which underlie and support the pressure points exerted by the skeletal structure of a human foot received in the shoe during a stride;

the sole portion of the shoe permitting the lateral arch of the foot to pronate during a stride, the medial arch to pronate during a stride and the forefoot to splay during a stride;

the sole portion having a heel area, a lateral arch area and a toe area, the thickness of the heel area, the lateral arch area and the toe area being approximately the same such that no appreciable forward or backward tilt is imparted to the skeletal and muscular structures above the foot;

side wall portions extending upwardly from the sole portion adjacent the lateral arch and the medial arch areas, whereby the shoe assembly when receiving, containing and supporting a human foot allows its normal and unconstrained pronation and supination motion during a stride.

2. A shoe assembly as set forth in claim 1 in which the outer surface of the heel area is shaped to approximate the lower, posterior shape of the calcaneum bone of the human foot thereby to stabilize the heel and enhance the normal motion of a human foot during a stride.

3. A shoe assembly as set forth in claim 1 in which the sole portion includes a midfoot area to underlie the medial arch of a human foot received in the shoe, the medial arch area being raised relative to the heel area, toe area, and central midfoot region formed by the plantar aponeurosis of the shoe when the shoe is resting on a horizontal surface but relatively collapsing during a stride to approximate that horizontal surface.

4. A shoe assembly as set forth in claim 3 in which the lateral arch pad includes a plurality of pads movable relative to the heel pad and forefoot pads, the forefoot pads also being movable relative to one another.

5. A shoe assembly as set forth in claim 3 in which the motion of the shoe assembly components during a stride of a human foot received in the shoe, receives, supports and allows the normal pronation and supination action of the foot from heel strike to push-off.

6. A shoe assembly as set forth in claim 5 in which the structural components and materials of the shoe assembly are selected and interrelated to enhance the lateral and medial arch pronation of a human foot received in the shoe during a stride.

7. A shoe assembly as set forth in claim 3 in which the structural components and materials of the shoe assembly are selected and interrelated to receive and transfer energy, during the stride of a human foot received in the shoe assembly, from the heel area during heel strike then primarily along the lateral arch of the foot to the toe area as the weight is transferred during roll-forward of the stride to push-off, then return the energy to the medial arch portion of the shoe as the foot swings forward for the next contact of the stride.

8. A shoe assembly as set forth in claim 7 including a focal element in the medial arch portion underlying the first cuneiform to receive and absorb a transfer of energy during a stride of a foot received in the shoe.

9. A shoe assembly as set forth in claim 1 in which at least the outer surface of the midsole portion is of increased density.

10. A shoe assembly as set forth in claim 9 in which the midsole portion wraps around the lower portion of the shoe and includes a heel cup extending up the heel area and a toe box extending around the toe area of the shoe assembly.

11. A shoe assembly as set forth in claim 10 in which the outer surface of the heel cup and toe box are of increased density.

12. A shoe assembly as set forth in claim 1 in which the upper portion includes a portion wrapping about and supporting the ankle of the human foot received in the shoe assembly.

13. A shoe assembly as set forth in claim 1 in which the upper portion includes a heel cup section and a separate arch section, the arch section terminating to provide an open toe area.

14. A shoe assembly as set forth in claim 3 including a resilient band connecting the upper portion of the heel cup section to the upper portion of the arch section.

15. A shoe assembly as set forth in claim 1 in which the outer sole portion includes a generally triangular pad adjacent the forefoot pads, between the lateral arch and medial arch pads, pointing toward the heel pad and underlying the metatarsal arch.

16. A shoe assembly as set forth in claim 1 in which the lateral arch pad includes a multiplicity of separate pads.

17. A shoe assembly as set forth in claim 16 in which the lateral arch pads include a pad extending laterally beyond the lateral arch thereby to impede the ankle from buckling outward during a stride.

* * * * *

UNITED STATES PATENT AND TRADEMARK OFFICE

CERTIFICATE OF CORRECTION

PATENT NO. : 6,021,588
DATED : February 8, 2000
INVENTOR(S) : Todd A. Alviso

Figure 3:
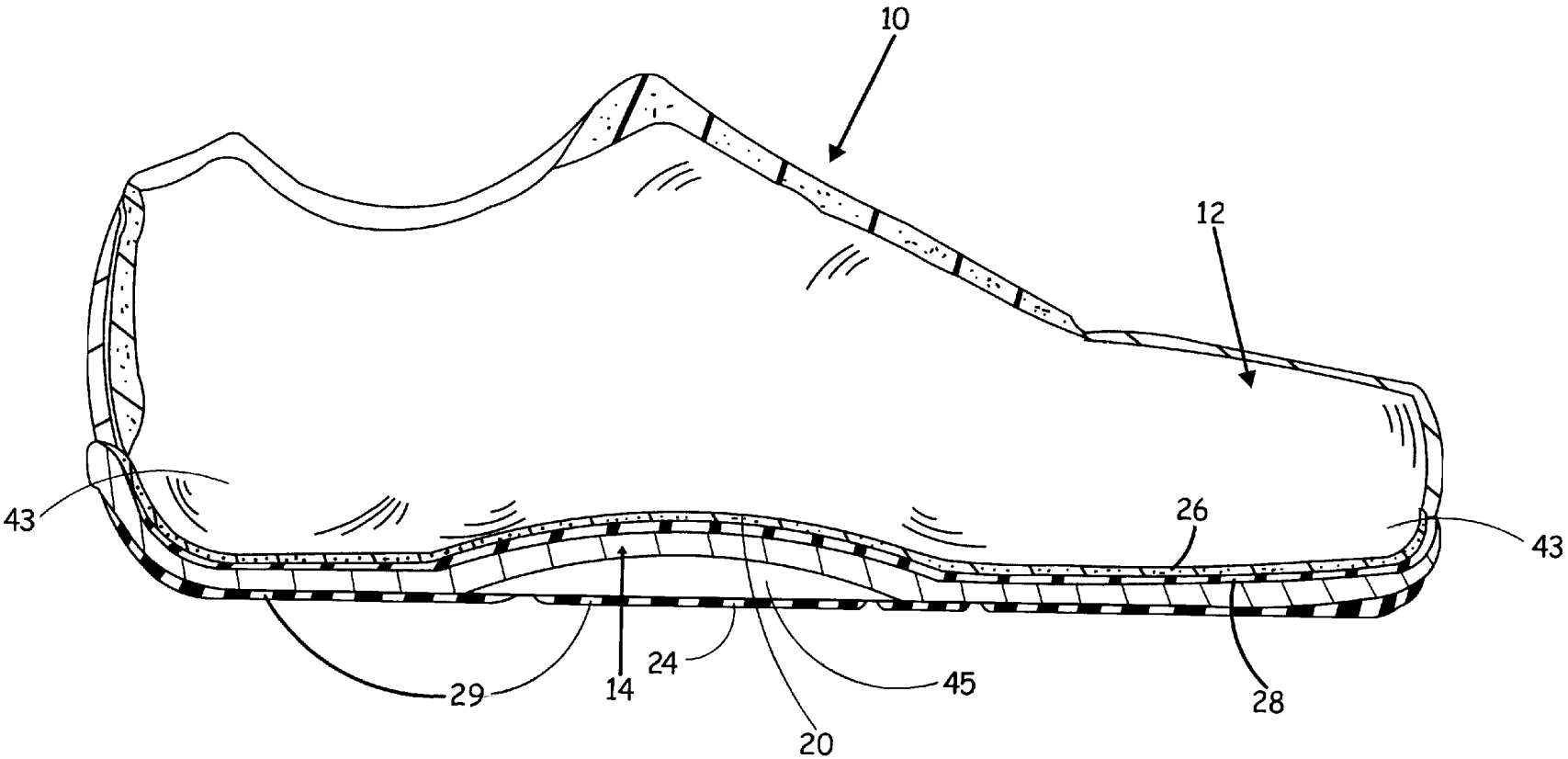
FIG. 3 is a vertical longitudinal cross-sectional view of the sneaker.

It is certified that error appears in the above-identified patent and that said Letters Patent is hereby corrected as shown below:

Drawing,
FIG. 3, please replace with the attached.

Signed and Sealed this

Twenty-fourth Day of August, 2004

JON W. DUDAS
*Director of the United States Patent and Trademark Office*

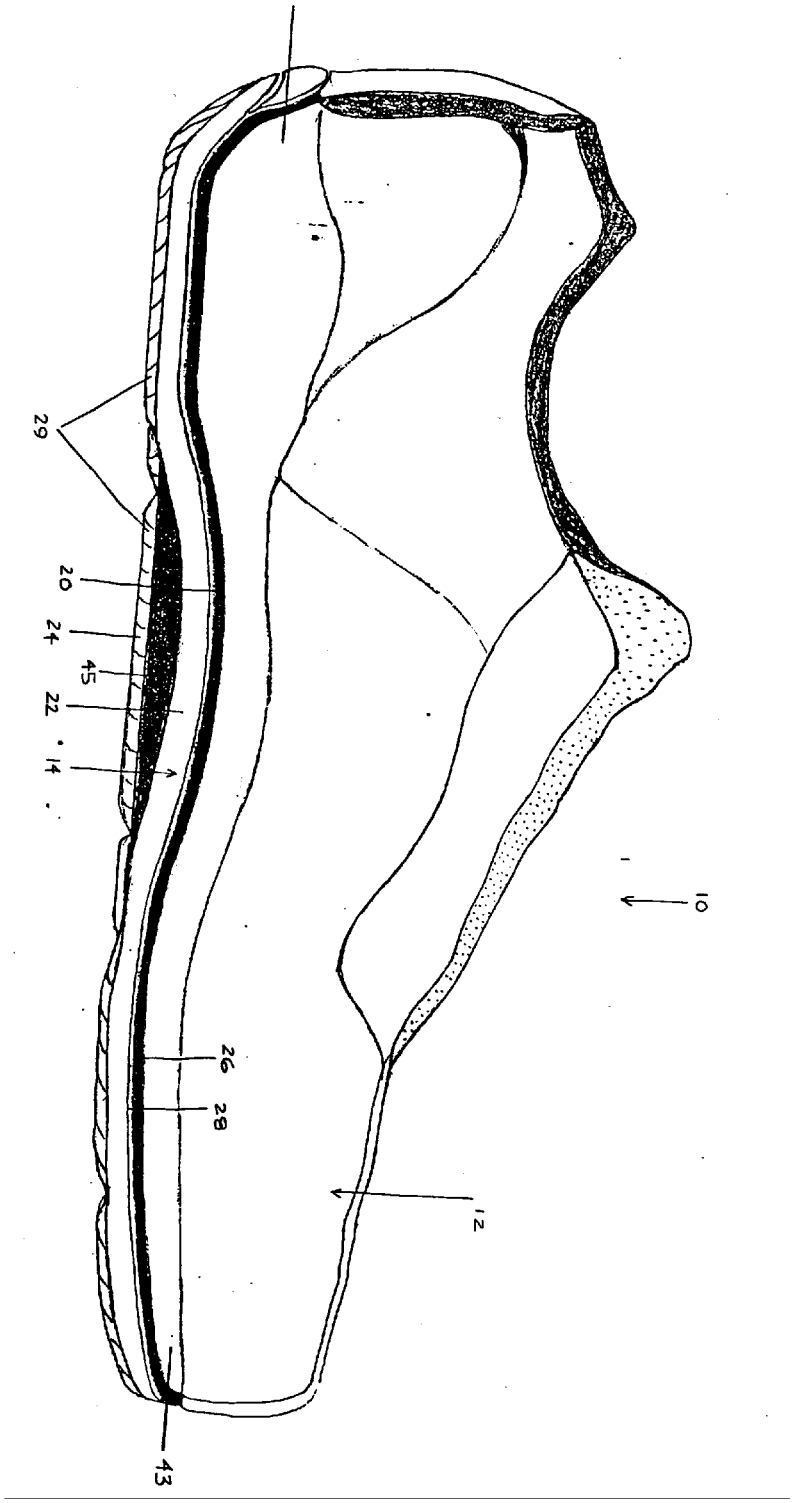
10
12
14
20
22
24
26
28
29
43
45